United States Patent [19]

O'Neill

[11] 4,436,014

[45] Mar. 13, 1984

[54] MITER BLOCK

[75] Inventor: Terence C. O'Neill, Northumberland, England

[73] Assignee: Internationale Octrooi Maatschappij "Octropa" B.V., Rotterdam, Netherlands

[21] Appl. No.: 348,045

[22] PCT Filed: Jun. 25, 1981

[86] PCT No.: PCT/GB81/00110

§ 371 Date: Feb. 5, 1982

§ 102(e) Date: Feb. 5, 1982

[87] PCT Pub. No.: WO82/00018

PCT Pub. Date: Jan. 7, 1982

[30] Foreign Application Priority Data

Jun. 25, 1980 [GB] United Kingdom ..... 8020828

[51] Int. Cl.[3] ..... B27G 5/02

[52] U.S. Cl. ..... 83/762; 145/29 R; 269/87.2; 269/295

[58] Field of Search ..... 83/762, 761; 145/29; 269/87.2, 295

[56] References Cited

U.S. PATENT DOCUMENTS

| | | | |
|---|---|---|---|
| 1,521,908 | 1/1925 | Schuster . | |
| 1,718,791 | 6/1929 | Ludwig | 83/762 |
| 2,518,801 | 8/1950 | Ludwig | 83/460 X |
| 2,799,077 | 7/1957 | Mitchell | 145/129 X |
| 2,875,796 | 3/1959 | Tesi | 83/762 |
| 3,837,253 | 9/1974 | Slemmons | 83/762 |
| 4,300,755 | 11/1981 | Potvin | 269/87.2 |

*Primary Examiner*—Donald R. Schran

*Attorney, Agent, or Firm*—Cushman, Darby & Cushman

[57] ABSTRACT

A miter block suitable for cutting a mitered end on a strip of material "L" shape in cross-section has a receiving slot extending from edge to edge in an upper surface to receive the strip of material and two cutter guide slots at right angles to one another, the slots having a common intersection with the receiving slot at one of the edges of the upper surface.

2 Claims, 1 Drawing Figure

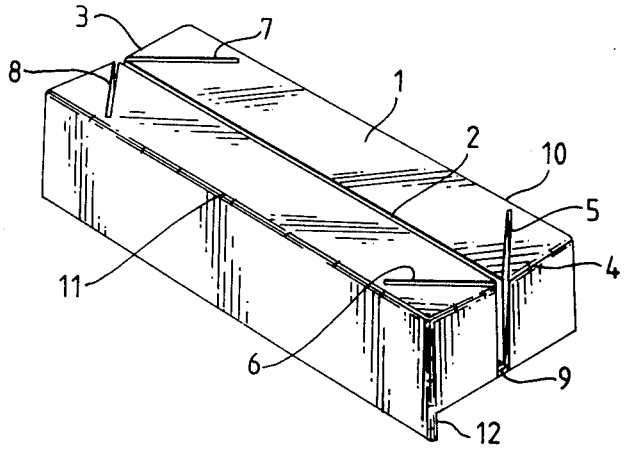
3
7
8
1
2
10
5
4
11
6
9
12

MITER BLOCK

This invention relates to improvements in or relating to a mitre block.

It is known to provide a mitre block of generally 'U' shaped cross-section having guide slots extending across both of the uprights of the block. The article to be mitred is positioned in the slot formed between the uprights and a cutting implement, commonly a saw, is guided by a guiding slot in each upright to cut at the required angle. Such a mitre block is difficult to employ for accurate cutting with a knife, particularly one with a short rigid blade, since the handle part of the knife is obstructed by one of the uprights.

According to the present invention there is provided a mitre block having an upper surface, a receiving slot extending from edge to edge in the upper surface adapted to receive a length of the material to be cut and two guide slots at right angles to one another, the guide slots intersecting with one another and with the receiving slot at one edge of the upper surface. By providing the cutting slots at the edge of the upper surface a knife can conveniently be used as the implement for cutting the material to be mitred without the handle of the knife being obstructed by the mitre block. A handle having a relatively short and therefore more rigid blade can be employed.

Preferably two guide slots are provided at both edges of the upper surface to intersect with the longitudinal slot at both ends thereof. The mitre block can then be used with the cutting implement in either hand. A downwardly extending stop having an engagement surface parallel to the receiving slot can be provided. The engagement surface can abut the front edge of a work bench or the like to assist in holding the mitre block in a steady position to facilitate accurate cutting.

An embodiment of the invention will now be described with reference to the accompanying perspective view of a mitre block according to the invention.

The mitre block has a rectangular flat upper surface 1 in which is provided a longitudinal receiving slot 2 extending between opposite edges 3 and 4 of the upper surface. At one end of the receiving slot 2 are provided guide slots 5 and 6 at right angles to one another and each intersecting with the receiving slot at the edge of the upper surface. Similar guide slots 7 and 8 are provided at the opposite edge of the upper surface to intersect with the receiving slot at that edge. The guide slots are at 45° to the receiving slot.

As can be seen from the drawing the receiving slot and the guide slots do not extend through the base 9 of the mitre block, since otherwise the block would no longer be in one piece. Similarly the guide slots 5, 6, 7 and 8 do not extend to the longitudinal edges 10 and 11 of the upper surface parallel to the receiving slot.

A downwardly extending stop in the form of a continuous flange 12 is provided parallel to the receiving slot to extend beyond the base 9 of the block.

In use the article to cut with a mitred end is positioned in the receiving slot. The receiving slot can be dimensioned to suit the size of particular articles to be cut so that the article is a push fit in the slot.

The block can then be held by hand with the flange 12 engaging e.g. the front edge of a work bench or table and a hand held knife guided by one of the slots 5, 6, 7 or 8 to cut a mitred end on the article. If the knife is held in the right hand the slots 5 and 6 can be used to cut opposite mitres at opposite ends of a length of material, the material being reversed end for end in the receiving slot for each cut.

If the knife is held in the user's left hand the slots 7 and 8 can be used more conveniently in the same way.

Whichever guide slot is used the mitre block does not impede the free use of the knife due to obstruction with the handle of the knife.

The mitre block of the present invention can be of solid construction but may conveniently be moulded of plastics materials having the slots formed in hollow ribs extending downwardly from the upper surface.

I claim:

1. A mitre block comprising a receiving slot to receive the article to be cut and two guide slots at right angles to one another for guiding the cutting implement, the guide slots intersecting with one another and with the receiving slot at a common intersection point at one end of the receiving slot.

2. A mitre block according to claim 1 having a downwardly extending stop with an engagement surface parallel to the receiving slot and two guide slots at both ends of the receiving slot.

* * * * *